US008295756B2

(12) United States Patent
Tsunoda

(10) Patent No.: US 8,295,756 B2
(45) Date of Patent: Oct. 23, 2012

(54) IMAGE FORMING APPARATUS

(75) Inventor: Arihiro Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 393 days.

(21) Appl. No.: 12/379,737

(22) Filed: Feb. 27, 2009

(65) Prior Publication Data

US 2009/0226229 A1 Sep. 10, 2009

(30) Foreign Application Priority Data

Mar. 6, 2008 (JP) ..... 2008-055746

(51) Int. Cl.
*G03G 21/00* (2006.01)

(52) U.S. Cl. ..... 399/350; 399/344; 399/349; 399/351

(58) Field of Classification Search ..... 399/344, 399/349, 350, 351
See application file for complete search history.

(56) References Cited

U.S. PATENT DOCUMENTS

| | | | | |
|---|---|---|---|---|
| 5,701,571 | A * | 12/1997 | Amamiya et al. | 399/343 |
| 6,029,025 | A | 2/2000 | Sakakibara et al. | |
| 6,055,404 | A * | 4/2000 | Yamazaki et al. | 430/119.82 |
| 6,212,344 | B1 | 4/2001 | Takagi et al. | |
| 6,640,080 | B2 * | 10/2003 | Endo et al. | 399/349 |
| 6,668,153 | B2 * | 12/2003 | Sakanobe et al. | 399/350 |
| 7,369,807 | B2 * | 5/2008 | Naruse et al. | 399/351 |
| 7,620,357 | B2 * | 11/2009 | Shakuto et al. | 399/350 |
| 7,817,956 | B2 * | 10/2010 | Sugimoto | 399/350 |
| 2002/0051143 | A1 | 5/2002 | Tsuruya | |
| 2006/0285898 | A1 * | 12/2006 | Watanabe et al. | 399/350 |
| 2007/0003337 | A1 * | 1/2007 | Shakuto et al. | 399/349 |

FOREIGN PATENT DOCUMENTS

| | | | |
|---|---|---|---|
| JP | 04149496 | A * | 5/1992 |
| JP | 5-165296 | | 7/1993 |
| JP | 6-195001 | | 7/1994 |
| JP | 6-195010 | | 7/1994 |
| JP | 8-123125 | | 5/1996 |
| JP | 10-49014 | | 2/1998 |
| JP | 2004198622 | A * | 7/2004 |
| JP | 2004-245881 | | 9/2004 |
| JP | 2005-241924 | | 9/2005 |
| JP | 2007-121719 | | 5/2007 |
| JP | 2007-225725 | | 9/2007 |
| JP | 2007286229 | A * | 11/2007 |
| JP | 2008-40137 | | 2/2008 |

* cited by examiner

*Primary Examiner* — David Gray
*Assistant Examiner* — Francis Gray
(74) *Attorney, Agent, or Firm* — Rabin & Berdo, P.C.

(57) ABSTRACT

The image forming apparatus has a plurality of image forming units for forming a developer image on a recording medium, and a fixing device for fixing the developer image to the recording medium. Each of said image forming units has an image bearing body that bears the developer image, and a cleaning portion that removes residual developer from said image bearing body. Said cleaning portion of said image forming unit is disposed closest to said fixing device and includes a cleaning blade that has repulsion elasticity at a predetermined temperature, and said repulsion elasticity is lower than that of a cleaning blade of said cleaning portion of at least one of said image forming units disposed farther from said fixing device.

8 Claims, 8 Drawing Sheets

FIG.6A
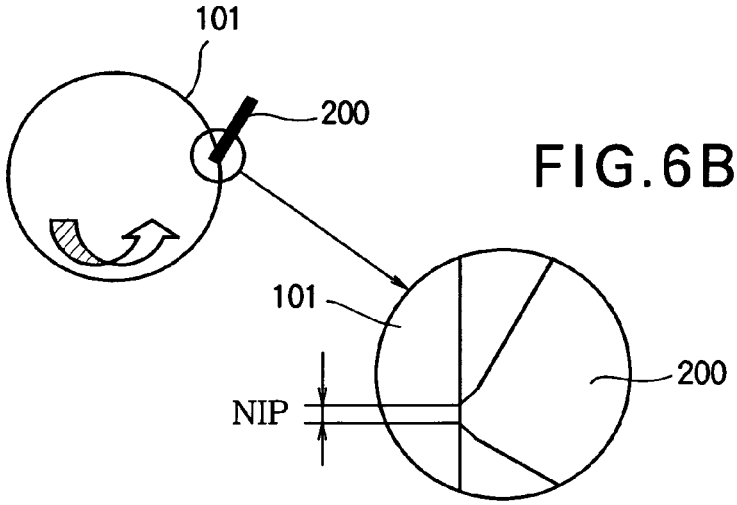
FIG.6B
FIG.7
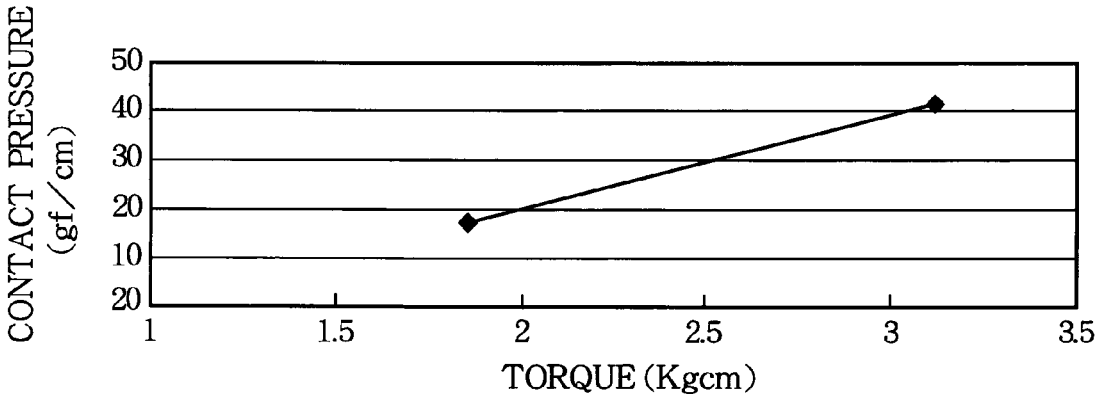
FIG.8
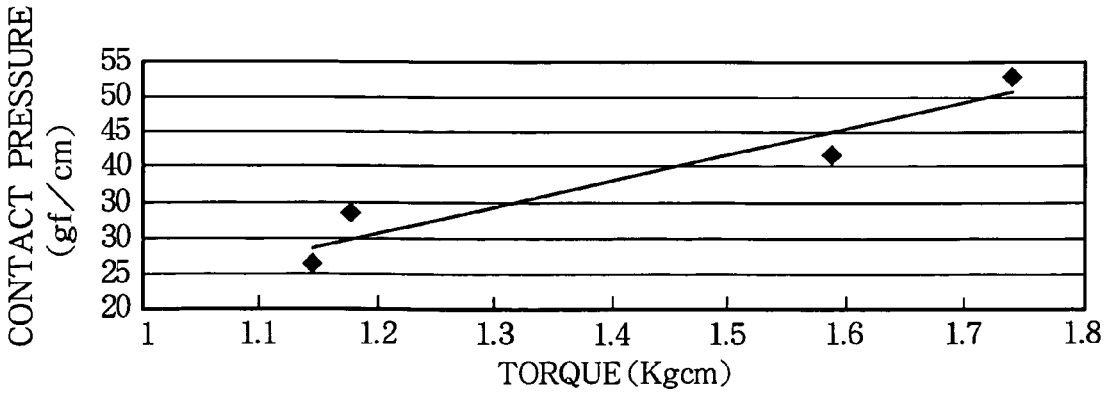

IMAGE FORMING APPARATUS

BACKGROUND OF THE INVENTION

The present invention relates to an image forming apparatus using electrophotographic technology.

Conventionally, an electrophotographic image forming apparatus includes an image bearing body that bears a developer image and a cleaning blade that removes residual developer from a surface of the image bearing body. In order to enhance cleaning performance of the image bearing body, it is proposed to use a cleaning blade with high module of repulsion elasticity (see, for example, Japanese Laid-open Patent Publication No. 2005-241924).

However, even when such a cleaning blade is used, there are cases where a cleaning failure may occur.

SUMMARY OF THE INVENTION

The present invention is intended to provide an image forming apparatus capable of enhancing cleaning performance of an image bearing body.

The present invention provides an image forming apparatus including a plurality of image forming units for forming a developer image on a recording medium, and a fixing device for fixing the developer image to the recording medium. Each of the image forming units includes an image bearing body that bears the developer image, and a cleaning portion that removes residual developer from the image bearing body. The cleaning portion of the image forming unit disposed closest to the fixing device is different from the cleaning portion of at least one of the image forming units disposed farther from the fixing device.

With such an arrangement, cleaning performance of the image bearing body can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIGS. 6A and 6B are a schematic view and an enlarged view for illustrating a nip portion formed between the cleaning blade and the photosensitive drum;

FIG. 7 is a graph showing a relationship between a contact pressure and a torque generated by the cleaning blade;

FIG. 8 is a graph showing a relationship between the contact pressure and the torque generated by the cleaning blade;

DETAILED DESCRIPTION OF THE PREFERRED EMBODIMENT

First Embodiment

Figure 1:
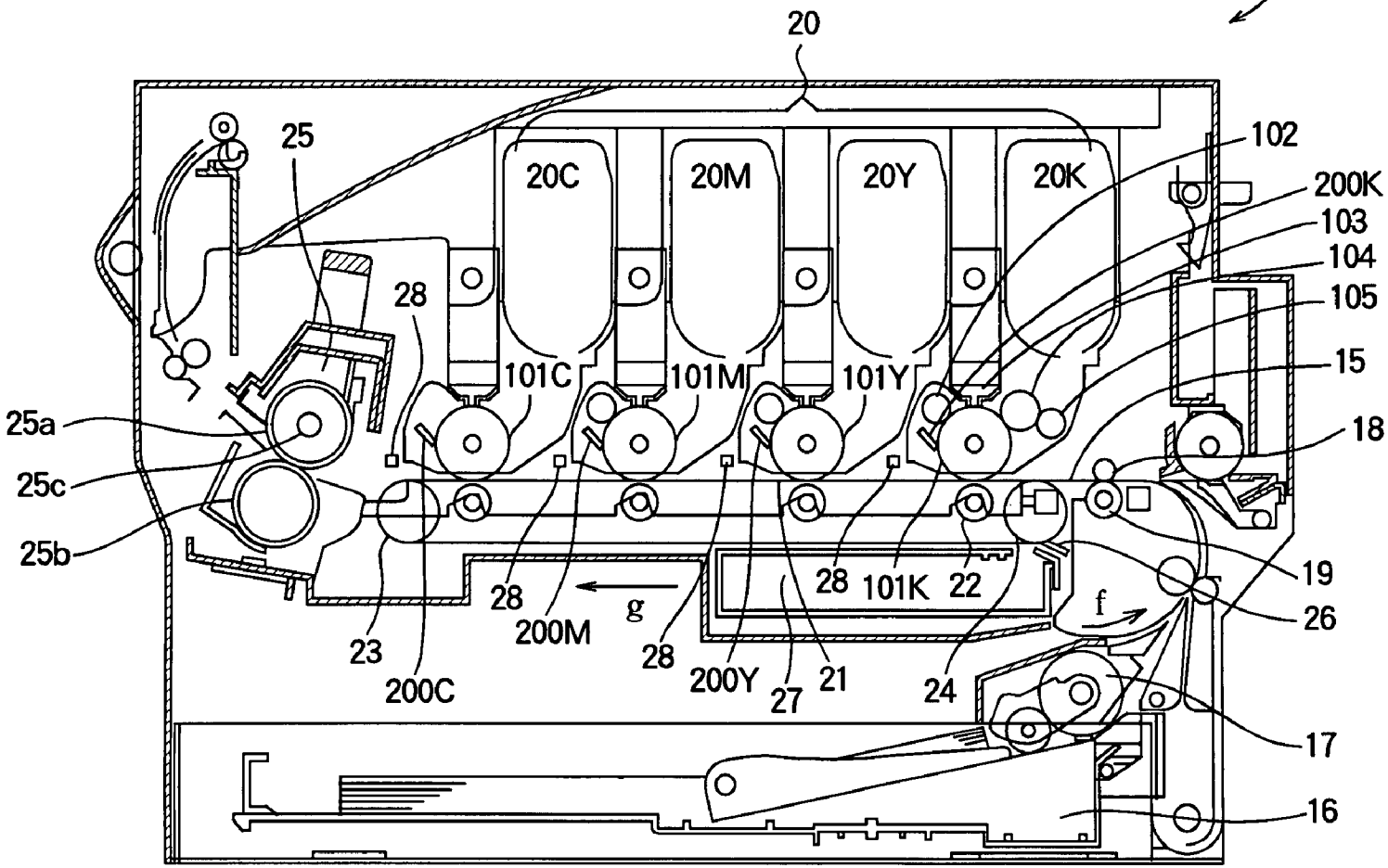
FIG. 1 is a schematic view showing a configuration of an image forming apparatus according to the first embodiment of the present invention.

FIG. 1 is a schematic view showing a configuration of a printer 10 as an image forming apparatus according to the first embodiment of the present invention. The printer 10 is configured as a color electrophotographic printer capable of printing a color developer image. The printer 10 includes a sheet cassette 16 in which sheets 15 (i.e., recording media) are stored, a hopping roller 17 that picks up the sheet 15 from the sheet cassette 16, and registration rollers 18 and 19 that correct skew of the sheet 15 and feed the sheet 15 to a transfer belt 21 described below. The printer 10 further includes the transfer belt 21 that electrostatically attracts and feeds the sheet 15, and a driving roller 23 and an idle roller 24 around which the transfer belt 21 is wound. The driving roller 23 is rotated by a power transmitted from a not shown driving portion, and causes the transfer belt 21 to move. The printer 10 further includes image forming unit units 20K, 20Y, 20M and 20C that form developer images on the sheet 15 fed by the transfer belt 21, and transfer rollers 22 that transfer the developer images (formed by the image forming units 20K, 20Y, 20M and 20C) to the sheet 15. The printer 10 further includes a fixing portion 25 (i.e., a fixing device) that fixes the developer image (transferred to the sheet 15) to the sheet 15, a transfer belt cleaning member 26 that scrapes off residual developer adhering to the transfer belt 21, a developer recovering container 27 that stores the developer scraped off by the transfer belt cleaning member 26, and temperature sensors 28.

The sheet cassette 16 stores a stack of the sheets 15 therein, and is detachably mounted to a lower part of the printer 10. The hopping roller 17 is disposed above the sheet cassette 16, and feeds the uppermost sheet 15 in a direction shown by arrow "f" in FIG. 1 along a sheet feeding path. The registration rollers 18 and 19, which are disposed along the sheet feeding path, correct skew of the sheet 15 and feed the sheet 15 to the transfer belt 21. The transfer belt 21 feeds the sheet 15 so that the sheet 15 passes the image forming units 20K, 20Y, 20M and 20C in this order.

The image forming units 20K, 20Y, 20M and 20C are detachably mounted to the printer 10, and respectively store developers of black (K), yellow (Y), magenta (M) and cyan (C) in this embodiment. The image forming units 20K, 20Y, 20M and 21C receives print data, and form developer images of the respective colors based on the print data as described later.

The transfer belt 21 is wound around the driving roller 23 rotated by the power transmitted from the driving portion (not shown) and the idle roller 24, and is moved by the rotation of the driving roller 23. The transfer belt 21 electrostatically attracts the sheet 15, and feeds the sheet 15 in a direction shown by arrow "g" (i.e., sheet feeding direction). The transfer rollers 22 are disposed so as to contact the transfer belt 21, and transfer the developer image (formed by the image forming units 20K, 20Y, 20M and 20C) to the sheet 15 by means of bias voltages applied by voltage supplying units (not shown).

The fixing device 25 is disposed on the downstream side of the image forming units 20K, 20Y, 20M and 20C along the sheet feeding path. The fixing device 25 includes a heat roller 25*a*, a pressure roller 25*b*, thermistor and a heater 25*c*. The heat roller 25*a* includes a cylindrical hollow metal core made of aluminum, a heat-resistant resilient layer made of silicone rubber covering the hollow metal core and a PFA (tetrafluoroethylene perfluoro alkyl vinyl ether copolymer) tube covering the heat-resistant resilient layer. Further, the heater 25*c* such as a halogen lamp is disposed in the hollow metal core. The pressure roller 25*b* includes a cylindrical hollow metal core made of aluminum, a heat-resistant resilient layer made of silicone rubber covering the hollow metal core and a PFT tube covering the heat-resistant resilient layer. The heat roller 25*a* and the pressure roller 25*b* form a nip portion therebetween. The thermistor (i.e., a detecting unit) is disposed in the vicinity of the heat roller 25*a* in non-contacting manner, and detects a surface temperature of the heat roller 25*a*. Temperature information detected by the thermistor is sent to a temperature control unit (not shown), and the temperature control unit performs on-off control of the heater 25*c* based on the temperature information so as to keep the surface temperature of the heat roller 25*a* at a predetermined temperature.

The transfer belt cleaning member 26 is composed of urethane rubber, and is disposed so as to contact the transfer belt 21. The transfer belt cleaning member 26 is disposed below the transfer belt 21, and scrapes off the residual developer from a lower part of the transfer belt 21 that moves in a direction opposite to the sheet feeding direction. The developer recovery container 27 is disposed at a position where the developer (having been scraped off by the transfer belt cleaning member 26) freely falls, and stores the developer.

The temperature sensors 28 detect temperatures in the vicinities of cleaning devices of the image forming units 20K, 20Y, 20M and 20C.

Although not shown in FIG. 1, the printer 10 includes the following components. That is, the printer 10 includes a printing control unit including a micro processor, a ROM (Read Only Memory), a RAM (Random Access Memory), an Input-Output Port, a timer and the like. The printer 10 further includes an interface control unit that receives print data and control command, and controls the printer 10 to execute printing operation. The printer 10 further includes a receiving memory that temporarily stores the print data inputted via the interface control unit. The printer 10 further includes an image data editing memory that receives the print data stored in the receiving memory, edits the print data to form image data, and stores the image data. The printer 10 further includes a display unit having a display device such as an LCD (Liquid Crystal Display), and an operating unit having an input unit such as a touch-panel operated by a user. The printer 10 further includes various kinds of sensors such as a sheet-position detection sensor, a temperature/humidity detection sensor and a density detection sensor for monitoring operation of the printer 10. The printer 10 further includes a head control unit that sends the image data stored in the image data editing memory to the LED (Light Emitting Diode) head 103 to thereby control the LED head 103. The printer 10 further includes a temperature control unit that controls a temperature of the fixing portion 25, a sheet feeding motor control unit that controls rotations of respective rollers for feeding the sheet 15, a driving control unit that controls a driving motor for rotating the photosensitive drum 101, a voltage supplying unit for supplying voltages to the respective rollers, and the like.

Next, the image forming unit 20 will be described. In this regard, the image forming units 20K, 20Y, 20M and 20C have the same configurations except the developers (colors), and collectively referred to as the image forming units 20.

Figure 2:
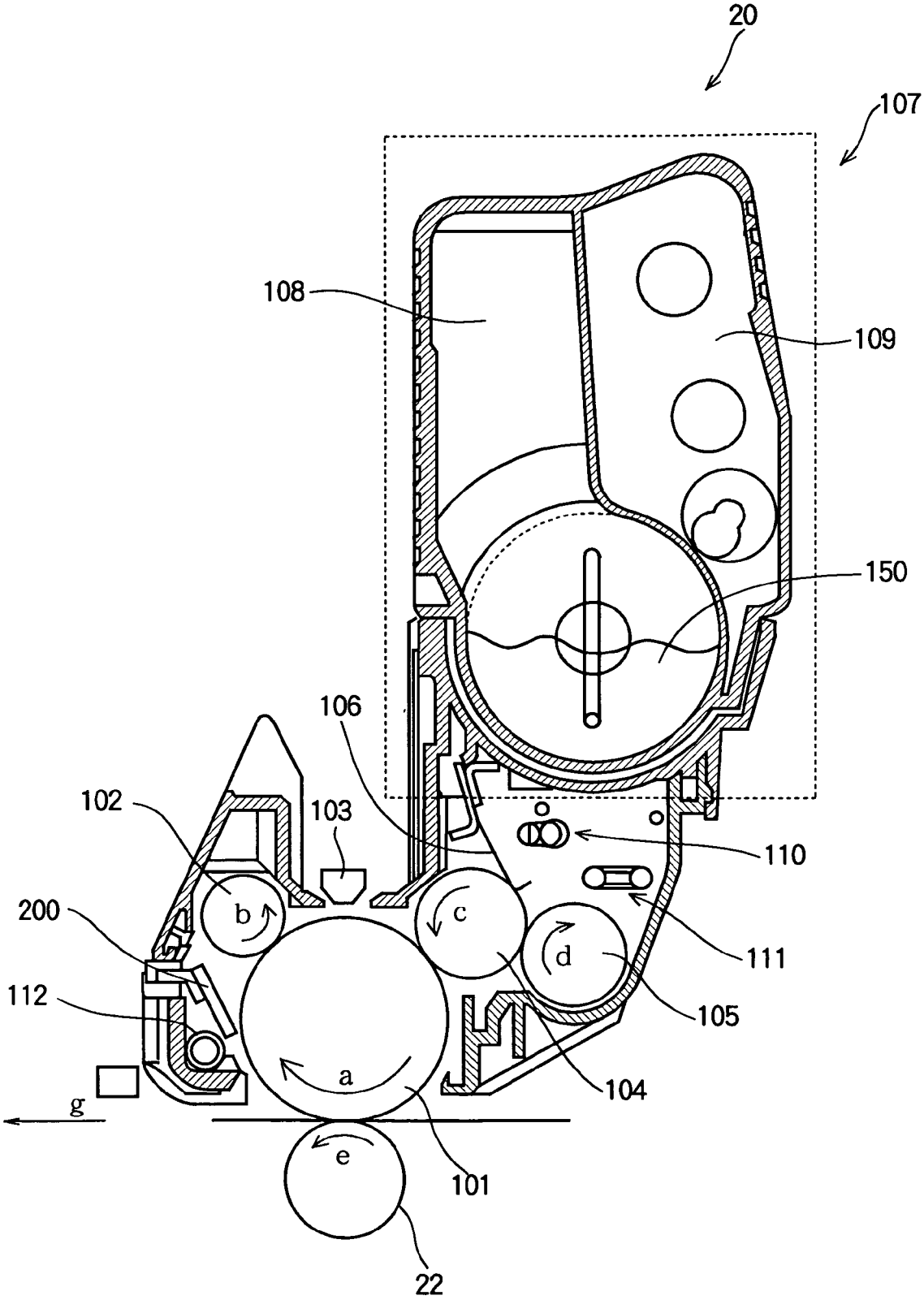
FIG. 2 is an enlarged sectional view showing a configuration of an image forming unit according to the first embodiment of the present invention.

FIG. 2 is a schematic view showing a configuration of the image forming unit 20. The image forming unit 20 includes a photosensitive drum 101, a charging roller 102, an LED head 103, a developing roller 104, a toner supplying roller 105, a developing blade 106, a toner storing unit 107, a toner agitating member 110, a toner carrying member 111, a spiral 112, a toner 150 as the developer, and a cleaning blade 200 as a cleaning device. The toner storing unit 107 is detachably mounted to the image forming unit 20.

The photosensitive drum 101 (i.e., an image bearing body) is an organic photosensitive body including a conductive supporting body and a photoconductive layer. The conductive supporting body is composed of a metal pipe of aluminum, and the photoconductive layer is composed of a charge generation layer and a charge transporting layer laminated on the metal pipe. The charging roller 102 is disposed so as to contact the circumferential surface of the photosensitive drum 101, and includes a metal shaft and a semiconductive epichlorohydrin rubber layer covering the metal shaft. The LED head 103 has a resolution of, for example, 600 dpi or 1200 dpi. The LED head 103 includes, for example, an LED element and a lens array, and is disposed so that light emitted by the LED element is focused on the circumferential surface of the photosensitive drum 101.

The developing roller 104 is disposed so as to contact the circumferential surface of the photosensitive drum 101, and includes a metal shaft and semiconductive urethane rubber layer covering the metal shaft. The toner supplying roller 105 is disposed so as to contact the developing roller 104, and includes a metal shaft and a semiconductive foamed silicone sponge layer covering the metal shaft. The developing blade 106 is made of, for example, stainless steel, and contacts the developing roller 104 in a counter direction with respective to a moving direction of the surface of the developing roller 104. The toner storing unit 107 is a container including a toner storing container 108 and a waste toner storing container 109. The toner agitation member 110 agitates the toner 150 supplied by the toner storing unit 107, and the toner carrying member 111 supplies the toner 150 to the toner supplying roller 105. The spiral 112 carries the waste toner scraped off by the cleaning blade 200 to a waste toner box (not shown). The waste toner in the waste toner box is carried along a waste toner carrying path (not shown) to the waste toner storing container 109, and is stored therein.

Although the toner 150 is not limited, it is preferable to use non-magnetic single-component toner (applicable to a color toner) that includes mother particles containing at least binder resin, coloring agent, charge controlling agent, releasing agent and the like, and includes an external additive for enhancing charging stability, developing property, fluidity and preserving property. Although the toner 150 can be manufactured by suspension method, solution suspension method, emulsion polymerization method or kneading pulverization method or the like, it is preferable to use the toner manufactured by emulsion polymerization method or kneading pulverization method. This is because, using emulsion polymerization method and kneading pulverization, it is possible to manufacture indefinitely-shaped toner that is less likely to form closest packed structure.

The cleaning blade 200 as the cleaning device is formed of, for example, urethane rubber. The cleaning blade 200 contacts the circumferential surface of the photosensitive drum 101 to scrape off the toner 150 therefrom. The detail of the cleaning blade 200 will be described later.

An operation of the above configured printer 10 will be described. As shown in FIG. 2, the photosensitive drum 101 rotates at a constant circumferential speed in a direction shown by arrow "a" by the driving control unit (not shown). The charging roller 102 contacting the surface of the photosensitive drum 101 rotates in a direction shown by arrow "b", and applies a direct voltage (supplied by the voltage supplying unit) to the surface of the photosensitive drum 101 to uniformly charge the surface of the photosensitive drum 101. The LED head 103 facing the photosensitive drum 101 irradiates the surface of the photosensitive drum 101 (having been uniformly charged) according to the image data to cause electric potential of the irradiated parts to decrease, so as to form a latent image.

The toner supplying roller 105 is applied with a voltage by the voltage supplying unit (not shown) and rotates in a direction shown by arrow "d" in FIG. 2. The toner 150 falls from the toner storing unit 107, and is supplied to the developing roller 104 by the toner supplying roller 105.

The developing roller 104 is disposed so as to tightly contact the photosensitive drum 101, and is applied with a voltage by the voltage supplying unit (not shown). The developing roller 104 holds the toner 150 supplied by the toner supplying roller 105, and rotates in a direction shown by arrow "c" to carry the toner 150 in the same direction. The developing blade 106 is pressed against the developing roller 104 on the downstream side of the toner supplying roller 105, and forms a developer layer (i.e., a toner layer) having a uniform thickness on the surface of the developing roller 104.

The developing roller 104 reversely develops the latent image on the photosensitive drum 101 using the toner borne by the developing roller 104. A bias voltage is applied between the conductive supporting body of the photosensitive drum 101 and the developing roller 104 by a high voltage power source (not shown), and lines of electromagnetic force generate between the developing roller 104 and the photosensitive drum 101 according to the latent image. The charged toner 150 on the developing roller 104 adheres to the photosensitive drum 101 by the electromagnetic force, and develops the latent image to form a developer image. This developing process (that starts with the starting of rotation of the photosensitive drum 101) starts at a predetermined timing.

As shown in FIG. 1, the sheet 15 stored in the sheet cassette 16 is fed one by one in the direction shown by arrow "f" by the hopping roller 17. The sheet 15 is guided by sheet guides (not shown) along the sheet feeding path, and the skew of the sheet 15 is corrected by the registration rollers 18 and 19. The sheet 15 fed by the registration rollers 18 and 19 reaches the transfer belt 21 driven by the driving roller 23. The developing process starts at a predetermined timing while the sheet 15 is fed by the registration rollers 18 and 19 or the transfer belt 21.

The transfer roller 22 is pressed against the photosensitive drum 101 of the black image forming unit 20K (via the transfer belt 21), and is applied with a voltage by the voltage supplying unit (not shown). The transfer roller 22 transfers the black developer image on the photosensitive drum 101 of the image forming unit 20K (having been formed in the above described developing process) to the sheet 15 electrostatically adhering to and fed by the transfer belt 21, i.e., a transfer process is performed.

Then, the sheet 15 is fed by the transfer belt 21 in a direction shown by arrow "g" in FIG. 1, and yellow, magenta and cyan developer images are respectively transferred to the sheet 15 in similar manners to the black developer image.

The sheet 15 with the developer image (i.e., toner image) of the respective colors having been transferred is fed to the fixing portion 25 including the heat roller 25*a* and the pressure roller 25*b*. The heat roller 25*a* generates heat to melt the toner. The heat roller 25*a* and the pressure roller 25*b* are pressed against each other, and the developer image is fixed to the sheet 15.

The sheet 15 with the developer image having been fixed is further fed, and is ejected out of the printer 10.

After the above described transfer process, a small amount of toner 150 (i.e., residual toner) may remain on the surface of the photosensitive drum 101. The residual toner 150 is removed by the cleaning blade 200. The cleaning blade 200 is disposed parallel to a rotation axis of the photosensitive drum 101. A root of the cleaning blade 200 is fixed to a rigid supporting plate (not shown) in such a manner that a tip (an edge) of the cleaning blade 200 contacts the surface of the photosensitive drum 101. The photosensitive drum 101 rotates about the rotation axis while the cleaning blade 200 contacts the circumferential surface of the photosensitive drum 101, so that the residual toner 150 remaining on the surface of the photosensitive rum 101 is removed. The photosensitive drum 101 having been cleaned by the cleaning blade 200 is repeatedly used.

There are cases where part of insufficiently charged toner may be transferred from the photosensitive drum 101 to the transfer belt 21. The toner transferred to the transfer belt 21 is removed by the transfer belt cleaning blade 26 during the movement of the transfer belt 21, and is stored in the developer recovery container 27. The transfer belt 21 having been cleaned by the transfer belt cleaning blade 26 is repeatedly used.

By cooperation of above described components, the printer 10 forms an image on the sheet 15.

Next, the cleaning blade 200 according to the first embodiment will be described. Hereinafter, a problem of a cleaning blade of a general printer will be first described, and then the cleaning blade 200 according to the first embodiment capable of solving the problem will be described.

Generally, in order to enhance image quality of the printer, a toner 150 including mother particles with small mean particle diameter is used. In such a case, a fluidity of the toner 150 may be lowered, and image failure such as image blurring occurs. Therefore, in order to enhance the fluidity, a large amount of external additive such as silica is added to the toner 150. For example, as shown in TABLE 1, when the mean particle diameter of the mother particles of the toner 150 is 8 μm, the toner 150 includes 1.3 wt % of silica A (40 nm), 0.6 wt % of silica B (14-16 nm) and 0.1 wt % of silica C (150 nm) as the external additive. In contrast, when the mean particle diameter of the mother particles of the toner 150 is 5.7 μm, the toner 150 includes 1.7 wt % of silica A (40 nm), 0.98 wt % of silica B (14-16 nm) and 0.4 wt % of silica C (150 nm) as the external additive. Since a large amount of the external additive whose mean particle diameter is smaller than or equal to 20 nm (i.e., silica B) is contained, such external additive may pass the cleaning blade (i.e., the cleaning device) if there is wear or the like on the cleaning blade.

TABLE 1

| MOTHER PARTICLE DIAMETER (μm) | SILICA A (wt %) | SILICA B (wt %) | SILICA C (wt %) | TOTAL (wt %) |
|---|---|---|---|---|
| 8 | 1.3 | 0.6 | 0.1 | 2.0 |
| 5.7 | 1.7 | 0.98 | 0.4 | 3.1 |

Figure 3:
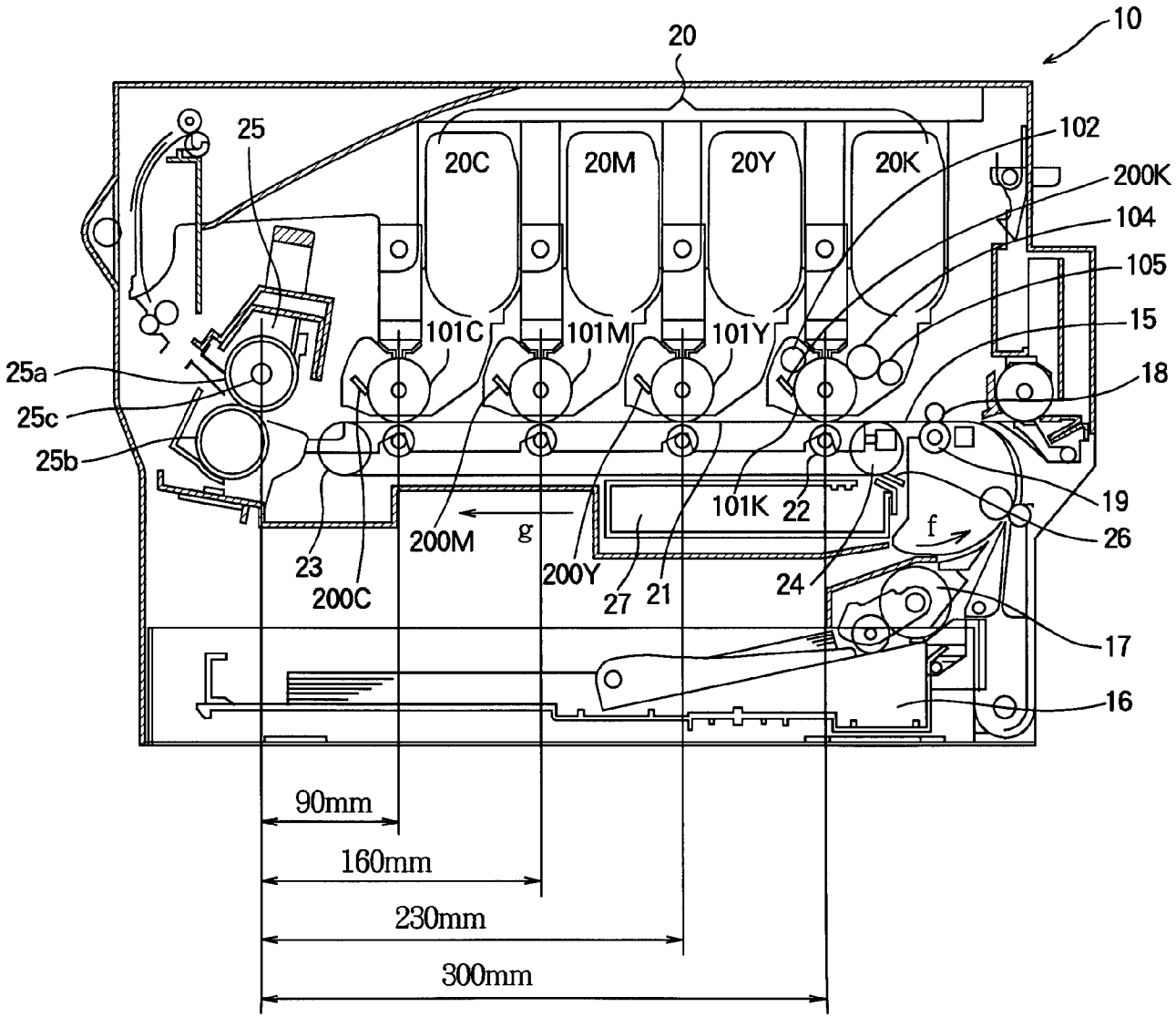
FIG. 3 is a schematic view for illustrating positions of respective image forming units in the image forming apparatus.
Figure 4A:
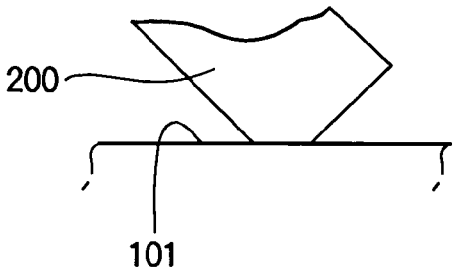
FIGS. 4A, 4B, 4C and 4D are schematic views for illustrating a stick-and-slip movement of a cleaning blade.
Figure 4B:
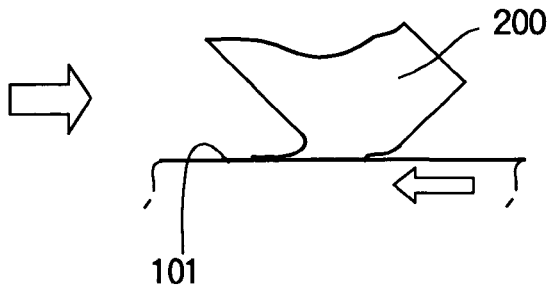
Figure 4C:
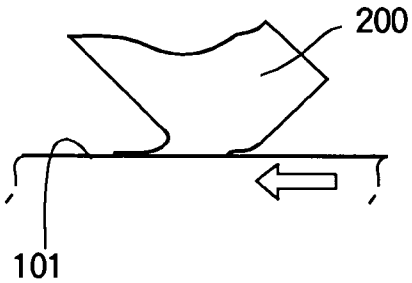
Figure 4D:
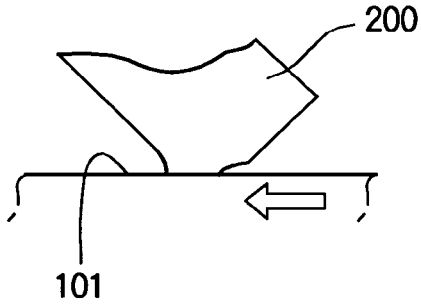

Due to the structure of the printer 10, one of the image forming units 20 (i.e., the image forming unit 20C) is disposed closest to the fixing portion 25 that generates heat. FIG. 3 illustrates examples of distances from the rotation axis of the heat roller 25*a* of the fixing portion 25 to the respective rotation axes of the photosensitive drums 101 of the image forming units 20K, 20Y, 20M and 20C. For example, the distance from the heat roller 25*a* to the photosensitive drum 101 of the closest image forming unit 20C is 90 mm. In contrast, the distance from the heat roller 25*a* to the photosensitive drum 101 of the farthest image forming unit 20K is 300 mm. That is, the longest distance (300 mm) is 3.3 times the shortest distance (90 mm). The heat generated by the fixing unit 25 (i.e., the heat roller 25*a*) influences cleaning performances of the respective cleaning blades (i.e., the cleaning devices) of the image forming units 20. To be more specific, in a general image forming apparatus, cleaning failure is more likely to occur in the image forming unit 20C closest to the fixing portion 25, but is less likely to occur in the other image forming units 20K, 20Y and 20M. In other words, cleaning performance of the image bearing body varies depending on the position of the image forming unit 20 in the image forming apparatus.

Hereinafter, the cleaning blade 200 according to the first embodiment capable of preventing the above described problems will be described.

The cleaning blade 200 contacts the circumferential surface of the photosensitive drum 101 to remove the toner 150 therefrom as described above. In this regard, the cleaning blade 200 exhibits a behavior called as stick-and-slip motion. FIGS. 4A through 4D schematically illustrate the stick-and-slip motion of the cleaning blade 200. When the photosensitive drum 101 starts rotating in a state where the tip of the cleaning blade 200 contacts the circumferential surface of the photosensitive drum 101 (FIG. 4A), the tip of the cleaning blade 200 is deformed so as to be stretched in the moving direction of the circumferential surface of the photosensitive drum 101 due to a friction force between the tip of the cleaning blade 200 and the photosensitive drum 101 (FIG. 4B), which is referred to as a "stick" state. When the tip of the cleaning blade 200 is stretched to a predetermined amount (FIG. 4C), a repulsion force of the cleaning blade 200 exceeds the friction force, and the cleaning blade 200 returns to its original state (FIG. 4D), which is referred to as a "slip" state.

Generally, the cleaning blade 200 with low modulus of repulsion elasticity exhibits a smaller number of times of stick-and-slip movement with larger amplitude. In contrast, the cleaning blade 200 with high modulus of repulsion elasticity exhibits a larger number of times of stick-and-slip movement with smaller amplitude. In this regard, a "modulus of repulsion elasticity" indicates energy absorbed by a material when an object impacts the material. To be more specific, in a test in which an object having a predetermined weight falls from a predetermined height on a test piece, the modulus of repulsion elasticity is determined by a ratio of energy of the object when the object falls on the test piece to energy of the object when the object rebounds. The modulus of repulsion elasticity can be measured by a Lubke repulsion elasticity test using a pendulum. In the Lubke repulsion elasticity test, the modulus of repulsion elasticity is determined based on heights of fall and rebound of the pendulum. Alternatively, the modulus of repulsion elasticity can be measured by Trypso repulsion elasticity test using a solid disk. In the Trypso repulsion elasticity test, the modulus of repulsion elasticity is determined based on rotation angles of fall and rebound of the disk. These repulsion elasticity tests are defined in JIS (Japanese Industrial Standard) K6255. For example, if an object having a weight W falls through a height h1, impacts a test piece, and rebounds to a height h2, energy E absorbed by the test piece and modulus of repulsion elasticity R (%) are described as follows:

$$E=W\times(h1-h2),$$

$$R=(h2/h1)\times 100.$$

The modulus of repulsion elasticity is determined using these equations based on the heights h1 and h2. In this regard, R=0(%) means that the falling object rests on the test piece without rebound. Further, R=1(%) indicates that the object rebounds to the height of its fall. Further, (10−R)(%) corresponds to energy transferred to heat due to internal friction of the test piece.

The toner 150 passes the cleaning blade 200 in the slip state. The cleaning blade 200 with low modulus of repulsion elasticity is in the slip state for a longer time period than the cleaning blade 200 with high modulus of repulsion elasticity, which is disadvantageous in enhancing cleaning performance. However, the cleaning blade 200 with low modulus of repulsion elasticity repeats the stick-and-slip motion less frequently than the cleaning blade 200 with high modulus of repulsion elasticity, and therefore the tip (i.e., edge) of the cleaning blade 200 is rarely worn, and therefore the external additive hardly passes the cleaning blade 200.

In contrast, the cleaning blade 200 with high modulus of repulsion elasticity repeats the stick-and-slip motion of smaller amplitude more frequently, and therefore the cleaning blade 200 with high modulus of repulsion elasticity is in the slip state for a shorter time period than the cleaning blade 200 with low modulus of repulsion elasticity, which is advantageous in enhancing cleaning performance. However, the cleaning blade 200 with high modulus of repulsion elasticity repeats the stick-and-slip motion more frequently than the cleaning blade 200 with low modulus of repulsion elasticity, and therefore the tip (i.e., edge) of the cleaning blade 200 is likely to be worn, and therefore there is a possibility that the external additive passes the cleaning blade 200.

The cleaning blades 200 of the cleaning units 20K, 20Y, 20M and 20C are referred to as cleaning blades 200K, 200Y, 200M and 200C (i.e., cleaning portions).

The above described repulsion elasticity tends to increase as the temperature rises. Therefore, if the image forming unit 20 (in this example, the image forming unit 20C) closest to the fixing portion 25 has the cleaning blade 200C with high modulus of repulsion elasticity for enhancing cleaning performance, the disadvantage (i.e., wear on the edge of the cleaning blade 200C) due to high modulus of repulsion elasticity exceeds the advantage obtained by high modulus of repulsion elasticity. Therefore, in order to keep cleaning performance in the image forming unit 20C disposed closest to the fixing portion 25 (i.e., heated to a relatively high temperature), it is preferable that the cleaning blade 200C of the image forming unit 20C closest to the fixing portion 25 has lower modulus of repulsion elasticity than the cleaning blades 200K, 200Y and 200M of the image forming units 20K, 20Y, 20M.

Alternatively, it is preferable that the cleaning blade 200C of the image forming unit 20C closest to the fixing portion 25 is pressed against the photosensitive drum 101 with a higher pressure (line pressure) than the cleaning blades 200K, 200Y and 200M of the image forming units 20K; 20Y, 20M, so as to keep cleaning performance even when the edge of the cleaning 200C is worn (due to high modulus of repulsion elasticity at high temperature).

Example 1-1

In Example 1-1, the cleaning blade 200C of the image forming unit 20C closest to the fixing portion 25 has lower modulus of repulsion elasticity than the cleaning blades 200K, 200Y and 200M of other image forming units 20K, 20Y, 20M. The cleaning performances by the cleaning blades 200K, 200Y, 200M and 200C are evaluated as described below. A mounting position of the cleaning blade 200C used in this Example 1-1 will be described with reference to FIG. 5.

Figure 5:
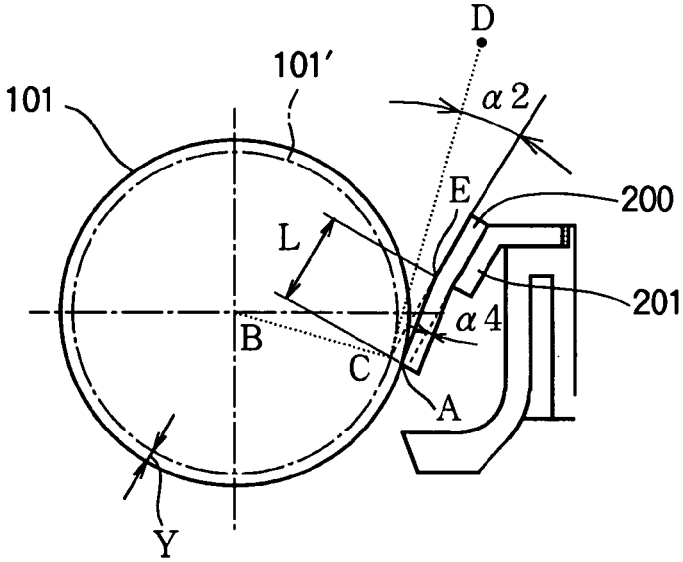
FIG. 5 is a schematic view for illustrating a positional relationship between the cleaning blade and a photosensitive drum.

FIG. 5 is a schematic view showing a positional relationship between the cleaning blade 200C and the photosensitive drum 101 of the image forming unit 20C (referred to as the photosensitive drum 101C). The cleaning blade 200C is supported by a cleaning blade supporting member 201, and contacts the circumferential surface of the photosensitive drum 101C at a position A. In this state, a pressing amount Y between the cleaning blade 200C and the photosensitive drum 101C is expressed as Y. In this regard, the "pressing amount" is an amount with which the cleaning blade 200C is assumed to be pressed into the photosensitive drum 101C on the assumption that the cleaning blade 20C is a rigid body as shown by dashed line in FIG. 5. The apparent circumference of the photosensitive drum 101 is shown by dashed-dotted line 101'. The pressing amount Y is determined based on a difference between a radius of the photosensitive drum 101C and a radius of the apparent circumference 101'. A normal line CD is defined to be perpendicular to a line BC connecting an imaginary tip C of the cleaning blade 200C (on the assumption that the cleaning blade 200C is a rigid body) and a center B of the photosensitive drum 101C. The cleaning blade 200C is mounted to the cleaning blade supporting member 201 in such a manner that an angle (i.e., a mounting angle) between the normal line CD and the cleaning blade 200C is an angle $\alpha 2$.

A deflection angle $\alpha 4$ of the cleaning blade 200C is determined based on a length (i.e., free end length) L from a supporting position E (where the cleaning blade 200C is supported by the cleaning blade supporting member 201) to the above described position A on the circumferential surface of the photosensitive drum 101, and the pressing amount Y.

$$\alpha 4=3\times Y\times 180/(2\times L\times 3.141516)$$

For example, when the pressing amount Y is 0.79 mm and the free end length L is 7.50 mm, the deflection angle $\alpha 4$ is 9.060.

Further, a cleaning angle $\alpha 1$ is determined based on the mounting angle $\alpha 2$ and the deflection angle $\alpha 4$ as follows:

$$\alpha 1=\alpha 2-\alpha 4$$

The cleaning angle $\alpha 1$ indicates a contact angle with which the cleaning blade 200C contacts the photosensitive drum 101C. For example, when the mounting angle $\alpha 2$ is 19.94° and the deflection angle $\alpha 4$ is 9.05°, the cleaning angle $\alpha 1$ is 10.890.

A contact pressure P between the cleaning blade 200C (mounted as described above) and the photoconductive drum 101C is determined based on the pressing amount Y, the free end length L, Young's Modulus $E_{young}$ and a thickness t of the cleaning blade 20C as follows:

$$P=Y\times E_{young}\times t^3/(4\times L^3).$$

For example, when the Young's Modulus $E_{young}$ is 68 kgf/cm$^2$, the thickness t of the cleaning blade 20C is 1.7 mm, the contact pressure P is 15.6 gf/cm.

Evaluation test is performed using two kinds of cleaning blades (i.e., referred to as blades A and B) as shown in TABLE 2. The cleaning angle $\alpha 1$ is 10.890, and the contact pressure P is 15.6 gf/cm. The outer diameter of the photosensitive drum 101 is 30 mm, and the circumferential speed of the photosensitive drum 101 is 0.154 m/s. For the evaluation test, the image forming units 20K, 20Y, 20M and 20C with the cleaning blades 200K, 200Y, 200M and 200C are mounted to the printer 10 in such a manner that the cyan image forming unit 20C, the magenta image forming unit 20M, the yellow image forming unit 20Y and the black image forming unit 20K are arranged in this order from the side closest to the fixing portion 25.

TABLE 2

| | | Blade A | Blade B |
|---|---|---|---|
| Hardness (JIS-A) (HS) | | 74 | 74 |
| Wallace Hardness (°) | | 76 | 76 |
| 100% Modulus (kgf/cm$^2$) | | 42 | 47 |
| 200% Modulus (kgf/cm$^2$) | | 78 | 96 |
| 300% Modulus (kgf/cm$^2$) | | 220 | 409 |
| Tension Strength (Kgf/cm$^2$) | | 442 | 653 |
| Elongation (%) | | 340 | 320 |
| Tear Strength (JIS-B) (kgf/cm$^2$) | | 59 | 55 |
| Permanent Elongation (%) (200% Elongation × 20 min) | | 1.7 | 1.6 |
| Modulus of Repulsion Elasticity (%) | 10° C. | 16 | 11 |
| | 23° C. | 29 | 20 |
| | 40° C. | 64 | 47 |
| | 55° C. | 81 | 69 |
| Modulus of Elasticity in Tension (Young's Modulus) | | 68 | 66 |
| Tan δ Peak Temperature (° C.) | | 4 | 6 |
| Friction Coefficient | | 1.1 | 1.08 |

In the evaluation test, "2 by 2" pattern is printed on 1400 pages of A4-size sheets (short edge feed). In this regard, "2 by 2" is obtained by forming 4 dots including 2 dots in vertical direction and 2 dots in lateral direction in a corner of 16 cells including 4 cells in the vertical direction and 4 cells in the lateral direction.

Whether the cleaning failure occurs or not is determined based on the presence or absence of the toner (having passed the cleaning blade 200) adhering to the surface of the charging roller 102. If the toner adhering to the charging roller 102 is found, it is determined that the cleaning failure occurs. If no toner adhering to the charging roller 102 is found, it is determined that the cleaning failure does not occur. Further, whether the external additive passes the cleaning blade 200 or not is determined based on the presence or absence of the external additive (having passed the cleaning blade 200) adhering to the surface of the charging roller 102. If the external additive adhering to the charging roller 102 is found, it is determined that the passing of the external additive occurs. If external additive adhering to the charging roller 102 is not found, it is determined that the passing of the external additive does not occur.

The temperature of the heat roller 25*a* of the fixing portion 25 is set to 180° C. The continuous printing is performed intermittently so that an idle time is set for every 3 pages of printing.

In Example 1-1, all of the cleaning blades 200K, 200Y, 200M and 200C of the image forming units 20K, 20Y, 20M and 20C are composed of the blade A (TABLE 1). The ambient temperature around the printer 10 is normal temperature (24° C.). The evaluations of the cleaning failure and the passing of the external additive are performed when the temperature of the printer 10 sufficiently increases during continuous printing (for example, when printing of 300 pages is completed). The evaluation result is shown in TABLE 3.

TABLE 3

| | Cyan | Magenta | Yellow | Black |
|---|---|---|---|---|
| Temperature (° C.) | 50 | 43 | 42 | 41 |
| Modulus of Repulsion Elasticity (%) | 76 | 68 | 67 | 65 |
| Cleaning Failure | None | None | None | None |
| Passing of External Additive | Found | None | None | None |

In TABLE 3, "Cyan", "Magenta", "Yellow" and "Black" respectively indicate the image forming units 20C, 20M, 20Y and 20K (the cleaning blades 200C, 200M, 200Y and 200K). The temperatures shown in TABLE 3 are measured by the temperature sensors 28 shown in FIG. 1. The moduli of repulsion elasticity of the cleaning blades are measured at the respective temperatures shown in TABLE 3.

In Example 1-1, the blades A with high modulus of repulsion elasticity are used in the image forming units 20K, 20Y, 20M and 20C as described above. At the normal ambient temperature (24° C.), when the temperature of the printer 10 sufficiently increases during the continuous printing (for example, when printing of 300 pages is completed), no cleaning failure is found in the image forming units 20K, 20Y, 20M and 20C. However, the passing of the external additive is found in the cyan image forming unit 20C. To be more specific, a large number of chips are found on the edge of the cleaning blade 200C of the cyan image forming unit 20C. Although no cleaning failure is found in the cyan image forming unit 20C, the external additive (having passed the cleaning blade 200C) adhere to the charging roller 102. In this regard, the chips on the edge of the cleaning blade 200C are observed using microscope at a magnification of 1000 times.

Example 1-2

In Example 1-2, the ambient temperature of the printer 10 is normal temperature (24° C.). The blades A with high modulus of repulsion elasticity are used as the cleaning blades 200K, 200Y and 200M of the image forming units 20K, 20Y and 20M, and the blade B with low modulus of repulsion elasticity is used as the cleaning blade 200C of the cyan image forming unit 20C. The evaluation method is the same as that of Example 1-1. The evaluation result is shown in TABLE 4.

TABLE 4

| | Cyan | Magenta | Yellow | Black |
|---|---|---|---|---|
| Temperature (° C.) | 50 | 43 | 42 | 41 |
| Modulus of Repulsion Elasticity (%) | 62 | 68 | 67 | 65 |
| Cleaning Failure | None | None | None | None |
| Passing of External Additive | None | None | None | None |

In Example 1-2, the blades A with high modulus of repulsion elasticity are used as the cleaning blades 200K, 200Y and 200M of the image forming units 20K, 20Y and 20M, and the blades B with low modulus of repulsion elasticity is used as the cleaning blade 200C of the cyan image forming unit 20C as described above. At the normal ambient temperature of 24° C., when the temperature of the printer 10 sufficiently increases (for example, when printing of 300 pages is completed), no cleaning failure is found in the image forming units 20K, 20Y, 20M and 20C. Further, no passing of the external additive is found in the image forming units 20K, 20Y, 20M and 20C.

Example 1-3

In Example 1-3, the ambient temperature of the printer 10 is low temperature (10° C.). The blades B with low modulus of repulsion elasticity are used as the cleaning blades 200K, 200Y, 200M and 200C of the image forming units 20K, 20Y, 20M and 20C. The evaluation method is the same as that of Example 1-1. In this regard, the evaluation (of the cleaning failure and the passing of the external additive) is performed when the temperature of the printer 10 is substantially the same as the ambient temperature or before the temperature of the printer 10 sufficiently increases (for example, when printing of 9 pages is completed). This corresponds to a state where the printer 10 is turned on after having been off for a long time, and a state where the printer 10 returns from power saving mode (in which the printing is not performed while the printer 10 is kept on) to start printing. The evaluation result is shown in TABLE 5.

TABLE 5

| | Cyan | Magenta | Yellow | Black |
|---|---|---|---|---|
| Temperature (° C.) | 35 | 12 | 10 | 10 |
| Modulus of Repulsion Elasticity (%) | 39 | 13 | 11 | 11 |
| Cleaning Failure | None | Found | Found | Found |
| Passing of External Additive | None | None | None | None |

In Example 1-3, the blades B with low modulus of repulsion elasticity are used as the cleaning blades 200K, 200Y, 200M and 200C of the image forming units 20K, 20Y, 20M and 20C as described above. At the low ambient temperature of 10° C., in a state where the temperature of the printer 10 does not sufficiently increase (such as shortly after the printer 10 starts printing from the temperature close to the ambient temperature, i.e., for example, when printing of 9 pages is completed), cleaning failure is found in black, yellow and magenta image forming units 20K, 20Y and 20M. In these image forming units 20K, 20Y and 20M, the cleaning blades 200K, 200Y and 200M have low modulus of repulsion elasticity, and allow the toner to pass and to adhere to the charging rollers 102. The reason is as follows. In the case where the printer 10 is kept in off-state or in power-saving mode for a long time at the low ambient temperature, the cleaning blades 200K, 200Y, 200M and 200C are at temperatures close to the ambient temperature. From this state, when the printer 10 is turned on or returns from the power-saving mode to start printing, the temperature of the cleaning blade 200C of the cyan image forming unit 20C closest to the fixing portion 25 rapidly increases, but the temperatures of the cleaning blades 200K, 200Y and 200M of the image forming units 20K, 20Y and 20M remain low. Therefore, the moduli of repulsion elasticity of the cleaning blades 200K, 200Y and 200M remain low. As a result, the cleaning blades 200K, 200Y and 200M exhibit insufficient cleaning performance, with the result that cleaning failure occurs in the image forming units 20K, 20Y and 20M.

Example 1-4

In Example 1-4, the ambient temperature of the printer 10 is low temperature (10° C.). The blades A with high modulus of repulsion elasticity are used as the cleaning blades 200K, 200Y and 200M of the image forming units 20K, 20Y and 20M, and the blade B with low modulus of repulsion elasticity is used as the cleaning blade 200C of the image forming unit 20C. The evaluation method is the same as that of Example 1-1. The evaluation result is shown in TABLE 6.

TABLE 6

| | Cyan | Magenta | Yellow | Black |
|---|---|---|---|---|
| Temperature (° C.) | 35 | 12 | 10 | 10 |
| Modulus of Repulsion Elasticity (%) | 39 | 18 | 16 | 16 |
| Cleaning Failure | None | None | None | None |
| Passing of External Additive | None | None | None | None |

In Example 1-4, the blades A with high modulus of repulsion elasticity are used as the cleaning blades 200K, 200Y and 200M of the image forming units 20K, 20Y and 20M, and the blade B with low modulus of repulsion elasticity is used as the cleaning blade 200C of the image forming unit 20C as described above. At the low ambient temperature of 10° C., in a state where the temperature of the printer 10 does not sufficiently increase (such as shortly after the printer 10 starts printing from the temperature close to the ambient temperature, i.e., for example, when printing of 9 pages is completed), no cleaning failure is found in the image forming units 20K, 20Y, 20M and 20C. Further, no passing of the external additive is found in the image forming units 20K, 20Y, 20M and 20C.

Example 1-5

In Example 1-5, the ambient temperature of the printer 10 is high temperature (32° C.), and the blades A with high modulus of repulsion elasticity are used as the cleaning blades 200K, 200Y, 200M and 200C of the image forming units 20K, 20Y, 20M and 20C. The evaluation method is the same as that of Example 1-1. The evaluation result is shown in TABLE 7.

TABLE 7

| | Cyan | Magenta | Yellow | Black |
|---|---|---|---|---|
| Temperature (° C.) | 55 | 48 | 47 | 46 |
| Modulus of Repulsion Elasticity (%) | 76 | 74 | 73 | 72 |
| Cleaning Failure | None | None | None | None |
| Passing of External Additive | Found | None | None | None |

In Example 1-5, the blades A with high modulus of repulsion elasticity are used as the cleaning blades 200K, 200Y, 200M and 200C of the image forming units 20K, 20Y, 20M and 20C as described above. At the high ambient temperature of 32° C., when the temperature of the printer 10 sufficiently increases (for example, when printing of 300 pages is completed), the passing of the external additive is found in the cyan image forming unit 20C. In this case, a large number of chips are found on the edge of the cleaning blade 200C. Although cleaning failure is not found in the cyan image forming unit 20C, the external additive (having passed the cleaning blade 200C) adhere to the surface of the charging roller 102.

Example 1-6

In Example 1-6, the ambient temperature of the printer 10 is high temperature (32° C.). The blades A with high modulus of repulsion elasticity are used as the cleaning blades 200K, 200Y and 200M of the image forming units 20K, 20Y and 20M, and the blade B with low modulus of repulsion elasticity is used as the cleaning blade 200C of the image forming unit 20C. The evaluation method is the same as that of Example 1-1. The evaluation result is shown in TABLE 8.

TABLE 8

| | Cyan | Magenta | Yellow | Black |
|---|---|---|---|---|
| Temperature (° C.) | 55 | 48 | 47 | 46 |
| Modulus of Repulsion Elasticity (%) | 69 | 74 | 73 | 72 |
| Cleaning Failure | None | None | None | None |
| Passing of External Additive | None | None | None | None |

In Example 1-6, the blades A with high modulus of repulsion elasticity are used as the cleaning blades 200K, 200Y and 200M of the image forming units 20K, 20Y and 20M, and the blade B having low modulus of repulsion elasticity is used as the cleaning blade 200C of the image forming unit 20C as described above. At the high ambient temperature of 32° C., when the temperature of the printer 10 sufficiently increases (for example, when printing on 300 pages is completed), no cleaning failure is found in the image forming units 20K, 20Y, 20M and 20C. Further, no passing of the external additive is found in the image forming units 20K, 20Y, 20M and 20C.

Examples 2-1, 2-2

From the results of Examples 1-1 and 1-5, it is understood that when the blades A with high modulus of repulsion elasticity are used as the cleaning blades 200K, 200Y, 200M and 200C of the image forming units 20K, 20Y, 20M and 20C, the passing of the external additive occurs in the image forming unit 20C at the normal ambient temperature (24° C.) and the high ambient temperature (32° C.). The reason is as follows. The cleaning blade 200C of the image forming unit 20C is heated by heat generated by the fixing portion 25, and the modulus of repulsion elasticity of the cleaning blade 200C increases, so as to cause excessive stick-and-slip movement. The stick-and-slip movement causes the edge of the cleaning blade 200C to be worn, and therefore a large number of chips are formed on the edge of the cleaning blade 200C, which allows the passing of the external additive.

Therefore, in Examples 2-1 and 2-2, it is determined whether the passing of the external additive is prevented by increasing a contact pressure (i.e., a nip width) between the cleaning blade 200 and the photosensitive drum 101 even when the edge of the cleaning blade 200C is worn. FIGS. 6A and 6B are a schematic view and an enlarged view for illustrating a nip portion between the cleaning blade 200 and the photosensitive drum 101. The nip width is determined as shown in FIG. 6B. The passing of the external additive can be restricted by increasing the nip width (NIP).

In this regard, the contact pressure between the cleaning blade 200 and the photosensitive drum 101 has a close relationship with a torque applied to the image forming unit 20. A torque (unit: kgcm) is a force required to rotate respective rollers of the image forming unit 20. If the torque is large, a motor is required to generate a large force for rotating respective rollers, and motor current increases. In such a case, the motor may generate heat, or the number of motor(s) needs to be increased (if respective rollers can not be rotated by one motor). Further, if the torque increases, the motor current may exceed a rated current value of the printer 10 (i.e., a current value for operating the printer 10 using household power source). For these reasons, it is necessary to reduce the torque applied to the image forming unit 20.

FIG. 7 shows a relationship between a torque (i.e., a blade torque) and a contact pressure generated by the cleaning blade 200 of the image forming unit 20 when the printer 10 is configured as A3-size printer. The relationship shown in FIG. 7 is based on the assumption that a steady load applied to the image forming unit 20 is generated by the cleaning blade 200 only. As shown in FIG. 7, for example, when the contact pressure increases by 24 gf/cm, the torque increases by 1.25 kgcm. Therefore, in the printer 10 including four image forming units 20, the torque increases by 5 kgcm in total.

FIG. 8 shows a relationship between the torque and the contact pressure generated by the cleaning blade 200 of the image forming unit 20 when the printer 10 is configured as A4-size printer. As shown in FIG. 8, for example, when the contact pressure increases by 24 gf/cm, the torque increases by 0.5 kgcm. Therefore, in the printer 10 including four image forming units 20, the torque increases by 2 kgcm in total.

As described above, if the contact pressures between the cleaning blades 200 and the photosensitive drums 101 of all image forming units 20 of the printer 10 increase, the torque excessively increases in total. For this reason, it is preferable to increase the contact pressure between the cleaning blade 200C and the photosensitive drum 101 only in the image forming unit 20C closest to the fixing portion 25.

Therefore, in Examples 2-1 and 2-2, the contact pressure between the cleaning blade 200 and the photosensitive drum 101 is increased only in the cyan image forming unit 20C. The evaluation test is performed at the normal ambient temperature (24° C.), the low ambient temperature (10° C.) and the high ambient temperature (32° C.). Other conditions are the same as those of Example 1-1.

Example 2-1

In Example 2-1, the cleaning angle $\alpha$1 is 10.890, the contact pressure is 15.6 gf/cm, the pressing amount is 0.70 mm, and the torque applied to the image forming unit 20C is 6.1 kgcm.

Example 2-2

In Example 2-2, the cleaning angle $\alpha$1 is 8.740, the contact pressure is 41.5 gf/cm, the pressing amount is 1.24 mm, and the torque applied to the image forming unit 20C is 6.7 kgcm.

TABLE 9 and TABLE 10 respectively show evaluation results of Examples 2-1 and Example 2-2.

TABLE 9

| Ambient Temperature | Cleaning Performance | Cyan | Magenta | Yellow | Black |
|---|---|---|---|---|---|
| 24° C. | Cleaning Failure | None | None | None | None |
| | Passing of External Additive | Found | None | None | None |

TABLE 9-continued

| Ambient Temperature | Cleaning Performance | Cyan | Magenta | Yellow | Black |
|---|---|---|---|---|---|
| 10° C. | Cleaning Failure | None | None | None | None |
| | Passing of External Additive | None | None | None | None |
| 32° C. | Cleaning Failure | None | None | None | None |
| | Passing of External Additive | Found | None | None | None |

TABLE 10

| Ambient Temperature | Cleaning Performance | Cyan | Magenta | Yellow | Black |
|---|---|---|---|---|---|
| 24° C. | Cleaning Failure | None | None | None | None |
| | Passing of External Additive | None | None | None | None |
| 10° C. | Cleaning Failure | None | None | None | None |
| | Passing of External Additive | None | None | None | None |
| 32° C. | Cleaning Failure | None | None | None | None |
| | Passing of External Additive | None | None | None | None |

In Example 2-1, no cleaning failure is found in the image forming units 20K, 20Y, 20M and 20C. However, the passing of the external additive is found in the cyan image forming unit 20C at the normal ambient temperature (24° C.) and at the high ambient temperature (32° C.) as in Example 1-1.

In contrast, in Example 2-2, no cleaning failure is found, and no passing of the external additive is found in the image forming units 20K, 20Y, 20M and 20C at the normal ambient temperature (24° C.), at the low ambient temperature (10° C.) and at the high ambient temperature (32° C.).

Therefore, it is understood that the passing of the external additive can be prevented by increasing a contact pressure (i.e., a nip width) between the cleaning blade 200C and the photosensitive drum 101 in the image forming unit 20C even when the edge of the cleaning blade 200C is worn.

As described above, according to the first embodiment, with the configuration in which the cleaning blade 200C of the image forming unit 20C closest to the fixing portion 25 has the lower modulus of repulsion elasticity than the cleaning blades 200K, 200Y and 200M of the image forming units 20K, 20Y and 20M, it becomes possible to reduce the cleaning failure and the passing of the external additive.

Alternatively, with the configuration in which the contact pressure between the cleaning blade 200C and the photosensitive drum 101 in the image forming unit 20C closest to the fixing portion 25 is larger than in the other image forming units 20K, 20Y and 20M, it is possible to reduce the cleaning failure and the passing of the external additive.

In the above described first embodiment, the cleaning blade 200C of the cyan image forming unit 20C has the modulus of repulsion elasticity different from the cleaning blades 200K, 200Y and 200M of the image forming units 20K, 20Y and 20M, or the contact pressure (with which the cleaning blade 200 is pressed against the photosensitive drum 101) in the image forming unit 20C is different from the contact pressure in the image forming units 20K, 20Y and 20M. However, the present invention is not limited to those configurations. For example, it is possible that the cleaning blades 200K, 200Y, 200M and 200C of the image forming units 20K, 20Y, 20M and 20C have moduli of repulsion elasticity different from each other. Further, it is also possible that the cleaning blades 200K, 200Y, 200M and 200C of the image forming units 20K, 20Y, 20M and 20C are pressed against the photosensitive drums 101 with contact pressures different from each other. For example, it is possible to set the moduli of repulsion elasticity $R_K$, $R_Y$, $R_M$ and $R_C$ of the cleaning blades 200K, 200Y, 200M and 200C so as to satisfy the relationship $R_C<R_M<R_Y<R_K$. Further, it is also possible to set cleaning angles so that the contact pressure $P_K$, $P_Y$, $P_M$ and $P_C$ with which the cleaning blades 200K, 200Y, 200M and 200C are pressed against the photosensitive drum 101 satisfy the relationship: $P_C>P_M>P_Y>P_K$.

Second Embodiment

In order to increase the printing speed, it is necessary to increase the feeding speed of the sheet, the rotational speed of the photosensitive drum and the fixing temperature. In such a case, if the cleaning device of the image forming unit closest to the fixing portion uses the cleaning blade, wear of the cleaning blade may increase as the modulus of repulsion elasticity increases (due to the heat of the fixing portion), or a filming may occur since the cleaning blade is pressed against the photosensitive drum at high temperature. Therefore, in the second embodiment of the present invention, the cleaning device of the image forming unit closest to the fixing portion uses a cleaning roller instead of the cleaning blade.

Figure 9:
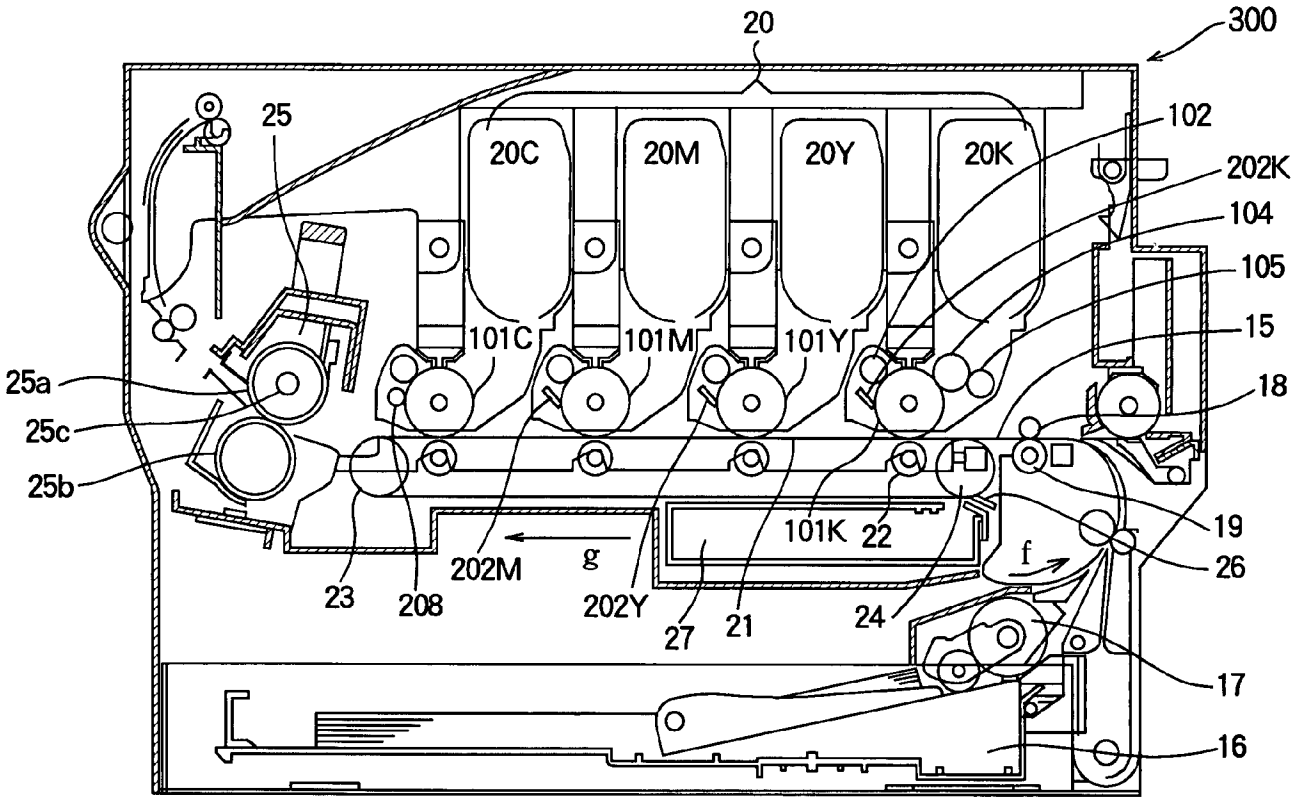
FIG. 9 is a schematic view showing a configuration of a printer according to the second embodiment of the present invention.
Figure 10:
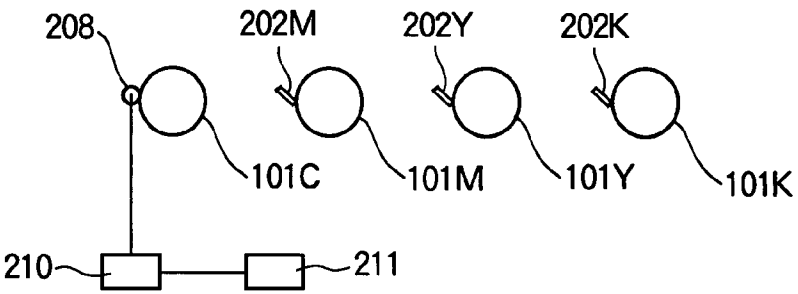
FIG. 10 is a schematic view for illustrating cleaning devices of respective image forming units according to the second embodiment.

FIG. 9 is a schematic view showing a configuration of a printer 300 as an image forming apparatus according to the second embodiment of the present invention. FIG. 10 is a schematic view for illustrating cleaning devices of, respective image forming units of the printer 300 according to the second embodiment.

The printer 300 of the second embodiment has substantially the same configuration as the printer 100 of the first embodiment except the difference described below. Components of the printer 300 which are the same as those of the printer 100 are assigned the same reference numerals, and explanations thereof will be omitted. Further, printing operation of the printer 300 is substantially the same as that of the printer 100 (except cleaning operation), and therefore explanations thereof will be omitted.

The printer 300 includes a cleaning roller 208 (i.e., a cleaning portion) as the cleaning device of the image forming unit 20C. The printer 300 further includes a voltage applying unit 210 and a voltage control unit 211 as a voltage supplying unit for the cleaning roller 208. The printer 300 further includes the cleaning blades 202K, 202Y and 202M (i.e., cleaning portions) as the cleaning devices of the image forming units 20K, 20Y and 20M instead of the cleaning blades 200K, 200Y and 200M of the first embodiment.

The cleaning roller 208 is composed of a conductive shaft (made of metal or the like) and a conductive resilient body provided around the conductive shaft. The conductive resilient body is composed of, for example, epichlorohydrin rubber in which carbon black (as conductive material) is dispersed. The cleaning roller 208 is mounted to the cyan image forming unit 20C.

The voltage applying unit 210 applies a voltage of, for example, +1000V whose polarity is opposite to the toner 150 to the cleaning roller 208. The voltage control unit 211 controls the voltage that the voltage applying unit 210 applies to the cleaning roller 208 and the timing when the voltage applying unit 210 applies the voltage to the cleaning roller 208.

The cleaning blades 202K, 202Y and 202M are formed of, for example, urethane rubber, and respectively contact the circumferential surfaces of the photosensitive drums 101 so as to remove the toner 150.

Next, the cleaning operation by the cleaning roller 208 of the cleaning unit 20C of the printer 300 will be described.

The cleaning roller 208 is applied with a voltage of, for example, +1000V whose polarity is opposite to the toner 150 as described above. With such a voltage, the cleaning roller 208 attracts the toner 150 from the circumferential surface of the photosensitive drum 101 (referred to as the photosensitive drum 101C) of the image forming unit 20C. In this regard, in the image forming unit 20C, the recovery operation of the toner 150 adhering to the cleaning roller 208 is performed between printing jobs or at predetermined intervals (for example, every 20 pages of printing). In the recovery operation, the toner 150 on the cleaning roller 208 is first transferred to the photosensitive drum 101C, then transferred to the transfer belt 21, and then recovered by the transfer belt cleaning member 26.

To be more specific, in the recovery operation, the cleaning roller 208 is applied with a voltage of −1400V by the voltage applying unit 210, with the result that the toner 150 moves to the surface of the photosensitive drum 101C whose electric potential is almost 0V.

As the photosensitive drum 101C rotates, the toner adhering to the photosensitive drum 101C moves to a portion facing the charging roller 102. In this state, the charging roller 102 is applied with a voltage of −1000V by the voltage supply portion (not shown), and therefore the toner 150 held on the photosensitive drum 101C passes the charging roller 102.

The LED head 103 exposes the photosensitive drum 101C to cause the electric potential of the photosensitive drum 101C to be 0V. As the photosensitive drum 101C further rotates, the toner moves to a portion facing the developing roller 104. In this state, the developing roller 104 is applied with a voltage of −300V by the voltage supplying portion (not shown), and therefore the toner 150 held on the photosensitive drum 101C passes the developing roller 104.

The transfer roller 22 is applied with +1000V by the supplying portion (not shown), and the toner on the photosensitive drum 101C is transferred to the transfer belt 21. As the transfer belt 21 moves, the toner 150 adhering to the transfer belt 21 is scraped off therefrom by the transfer belt cleaning member 26, and stored in the developer recovery container 27.

In the second embodiment of the present invention, the cleaning roller 208 is used as the cleaning device. However, the present invention is not limited to such a configuration. It is also possible to use other cleaning member that attracts the residual toner from the photosensitive drum by means of electric potential difference between the cleaning member and the photosensitive drum. For example, it is possible to use a brush roller composed of a conductive shaft and a brush provided around the conductive shaft.

As described above, according to the second embodiment of the present invention, the cleaning device of the image forming unit closest to the fixing portion is configured as the cleaning roller. Therefore, the printing speed can be increased, and the filming of the photosensitive drum can be prevented.

Third Embodiment

In order to increase the printing speed, it is necessary to increase the feeding speed of the sheet, the rotational speed of the photosensitive drum and the fixing temperature. In such a case, if the cleaning device of the image forming unit closest to the fixing portion uses the cleaning blade, wear of the cleaning blade may increase as the modulus of repulsion elasticity increases (due to the heat of the fixing portion), or a filming may occur since the cleaning blade is pressed against the photosensitive drum at high temperature. For this reason, it is difficult to sufficiently increase the contact pressure between the cleaning blade and the photosensitive drum, and therefore it is difficult to prevent cleaning failure. Therefore, in the third embodiment of the present invention, the cleaning device of the image forming unit closest to the fixing portion uses a cleaning blade and an auxiliary cleaning member.

Figure 11:
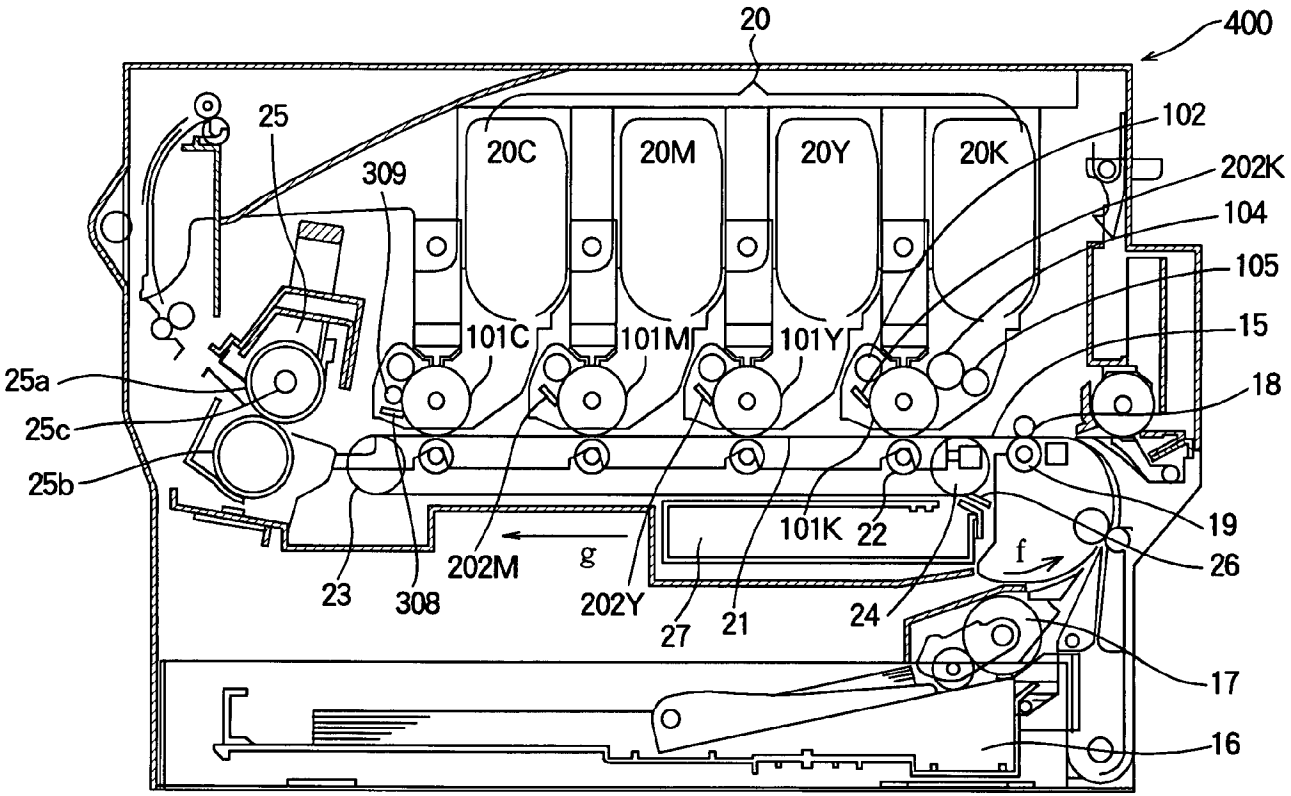
FIG. 11 is a schematic view showing a configuration of a printer according to the third embodiment of the present invention.
Figure 12:
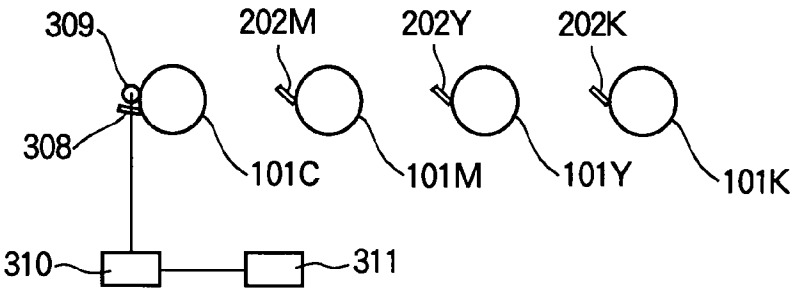
FIG. 12 is a schematic view for illustrating cleaning devices of respective image forming units according to the third embodiment.

FIG. 11 is a schematic view showing a configuration of a printer 400 as an image forming apparatus according to the third embodiment of the present invention. FIG. 12 is a schematic view for illustrating cleaning devices of respective image forming units 20 of the printer 400 according to the third embodiment.

The printer 400 of the third embodiment has substantially the same configuration as the printer 300 of the second embodiment except the cleaning device of the image forming unit 20C. Components of the printer 400 which are the same as those of the printer 300 are assigned the same reference numerals, and explanations thereof will be omitted. Further, printing operation of the printer 400 is substantially the same as that of the printer 300 (except cleaning operation), and therefore explanations thereof will be omitted.

The printer 400 includes a cleaning blade 308 (i.e. a first cleaning member) and a cleaning roller 309 (i.e., an auxiliary cleaning member, or a second cleaning member) that constitute the cleaning device (i.e., a cleaning portion) of the image forming unit 20C. The printer 400 further includes a voltage applying unit 310 and a voltage control unit 311 as a voltage supplying unit for the cleaning roller 309. The cleaning blades 202K, 202Y and 202M (i.e., cleaning portions) of the printer 400 are the same as those of the printer 300.

The cleaning blade 308 is composed of, for example, a urethane rubber or the like. The cleaning blade 308 is mounted to the cyan image forming unit 20C, and contacts the circumferential surface of the photosensitive drum 101C so as to scrape off the toner 150 therefrom.

The cleaning roller 309 is composed of a conductive shaft (made of metal or the like) and a conductive resilient body provided around the conductive shaft. The conductive resilient body is composed of, for example, epichlorohydrin rubber in which carbon black (as conductive material) is dispersed. The cleaning roller 309 is mounted to the cyan image forming unit 20C as well as the cleaning blade 308.

The voltage applying unit 310 applies a voltage of, for example, +1000V whose polarity is opposite to the toner 150 to the cleaning roller 309. The voltage control unit 311 controls the voltage that the voltage applying unit 310 applies to the cleaning roller 309 and the timing when the voltage applying unit 310 applies the voltage to the cleaning roller 309.

Next, the cleaning operation by the cleaning blade 308 and the cleaning roller 309 of the image forming unit 20C of the printer 400 will be described. The cleaning blade 308 contacts the surface of the photosensitive drum 101C, and scrapes off the toner 150 therefrom. Additionally, as described above, the cleaning roller 309 is applied with a voltage of, for example, +1000V whose polarity is opposite to the toner 150. With such voltage, the cleaning roller 309 attracts the toner 150 from the circumferential surface of the photosensitive drum 101C. In this regard, in the image forming unit 20C, the recovery operation of the toner 150 adhering to the cleaning roller 309 is performed between printing jobs or at predetermined intervals (for example, every 20 pages of printing). In the recovery operation, the toner 150 is first transferred to the photosensitive drum 101, then transferred to the transfer belt 21, and then recovered by the transfer belt cleaning member 26.

To be more specific, in the recovery operation, the cleaning roller 309 is applied with a voltage of −1400V by the voltage applying unit 310, with the result that the toner 150 moves to the surface of the photosensitive drum 101C whose electric potential is almost 0V.

As the photosensitive drum 101C rotates, the toner adhering to the photosensitive drum 101C moves to a portion facing the charging roller 102. In this state, the charging roller 102 is applied with a voltage of −1000V by the voltage supply portion (not shown), and therefore the toner 150 held on the photosensitive drum 101C passes the charging roller 102.

The LED head 103 exposes the photosensitive drum 101C to cause the electric potential of the photosensitive drum 101C to be 0V. As the photosensitive drum 101C further rotates, the toner moves to a portion facing the developing roller 104. In this state, the developing roller 104 is applied with the −300V by the voltage supplying portion (not shown), and therefore the toner 150 held on the photosensitive drum 101C passes the developing roller 104.

The transfer roller 22 is applied with +1000V by the supplying portion (not shown), and the toner on the photosensitive drum 101C is transferred to the transfer belt 21. As the transfer belt 21 moves, the toner 150 adhering to the transfer belt 21 is scraped off therefrom by the transfer belt cleaning member 26, and stored in the developer recovery container 27.

In the third embodiment of the present invention, the cleaning device uses the cleaning roller 309 as the auxiliary cleaning member. However, the present invention is not limited to such a configuration. It is also possible to use other cleaning member that attracts the residual toner from the photosensitive drum by means of electric potential difference between the cleaning member and the photosensitive drum. For example, it is possible to use a brush roller composed of a conductive shaft and a brush provided around the conductive shaft.

In the third embodiment, the cleaning roller 309 is disposed on the downstream side of the cleaning blade 308 as shown in FIG. 11 in the rotational direction of the photosensitive drum 101C. Therefore, even when the external additive or toner passes the cleaning blade 308, such external additive or toner can be removed by the cleaning roller 309 from the surface of the photosensitive drum 101C.

As described above, according to the third embodiment of the present invention, the cleaning device of the image forming unit closest to the fixing portion uses the cleaning roller as the auxiliary cleaning member in addition to the cleaning blade. Therefore, the printing speed can be increased, and the cleaning failure can be prevented.

Fourth Embodiment

In order to increase the printing speed, it is necessary to increase the feeding speed of the sheet, the rotational speed of the photosensitive drum and the fixing temperature. In such a case, the temperature of the cleaning device of the image forming unit closes to the fixing portion largely changes. Therefore, if the cleaning device of the image forming unit closest to the fixing portion uses the cleaning blade, the environmental conditions (temperature, humidity or the like) of the cleaning blade largely changes. Therefore, in the fourth embodiment of the present invention, the cleaning device of the image forming unit closest to the fixing portion uses a cleaning roller applied with a superimposed voltage in which alternate voltage and direct voltage is superimposed.

Figure 13:
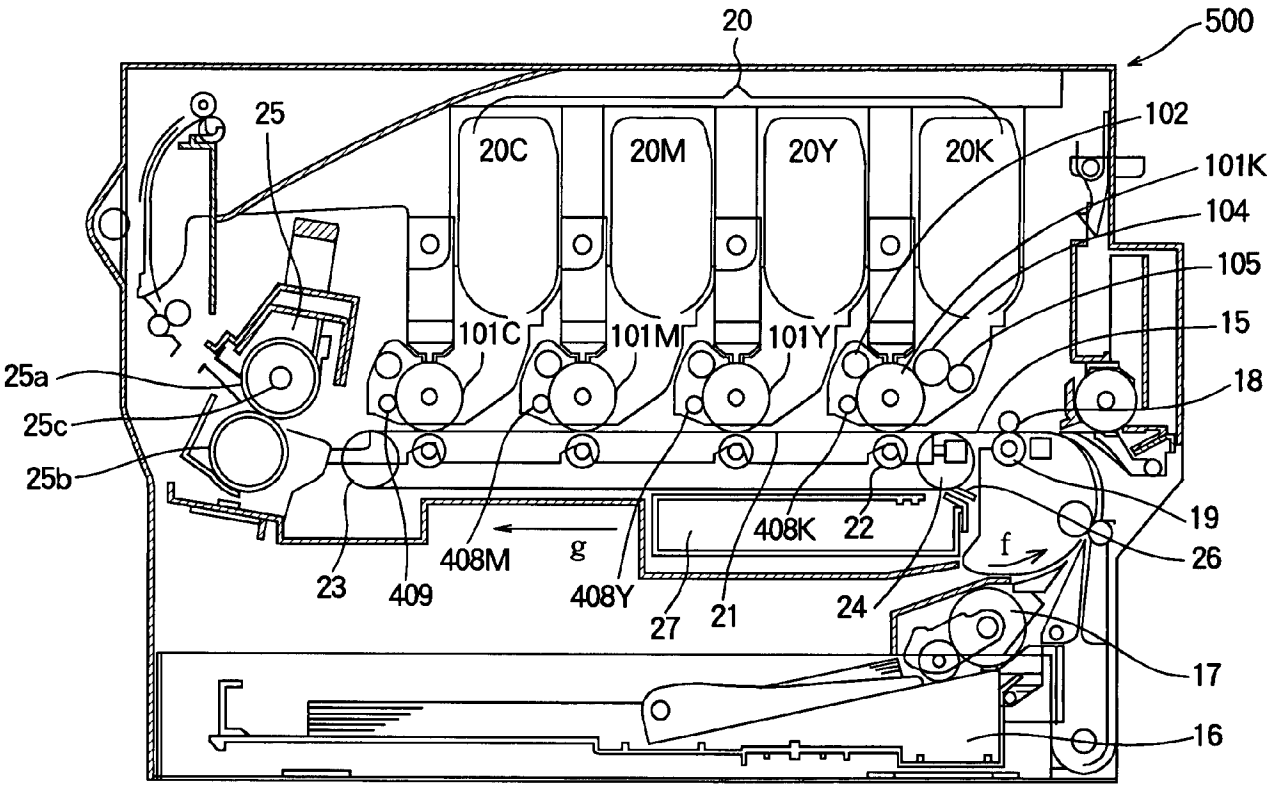
FIG. 13 is a schematic view showing a configuration of a printer according to the fourth embodiment of the present invention.
Figure 14:
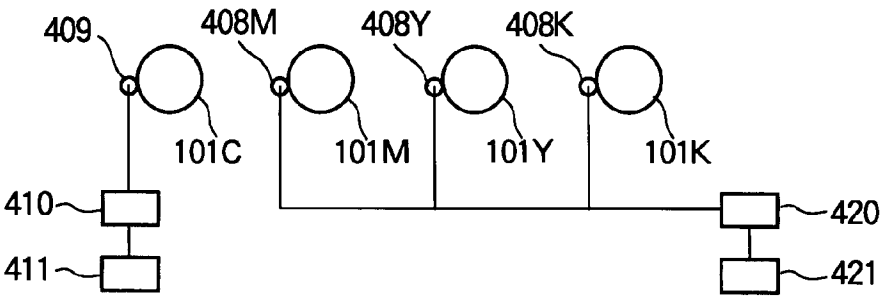
FIG. 14 is a schematic view for illustrating cleaning devices of respective image forming units according to the fourth embodiment.

FIG. 13 is a schematic view showing a configuration of a printer 500 as an image forming apparatus according to the fourth embodiment of the present invention. FIG. 14 is a schematic view for illustrating cleaning devices of respective image forming units 20 of the printer 500 according to the fourth embodiment.

The printer 500 of the fourth embodiment has substantially the same configuration as the printer 300 of the second embodiment except the cleaning devices of the image forming units 20K, 20M, 20Y and 20C. Components of the printer 500 which are the same as those of the printer 300 are assigned the same reference numerals, and explanations thereof will be omitted. Further, printing operation of the printer 500 is substantially the same as that of the printer 300 (except cleaning operation), and therefore explanations thereof will be omitted.

The printer 500 includes cleaning rollers 408K, 408Y and 408M (i.e., cleaning portions) instead of the cleaning blades 202K, 202Y and 202M of the printer 300. The printer 500 further includes a cleaning roller 409 (i.e., a cleaning portion) instead of the cleaning roller 208 of the printer 300. The printer 500 further includes a voltage applying unit 410 and a voltage control unit 411 as a voltage supplying unit for the cleaning roller 409. The printer 500 further includes a voltage applying unit 420 and a voltage control unit 421 as a voltage supplying unit for the cleaning rollers 408K, 408Y and 408M.

Each of the cleaning rollers 408K, 408Y and 408M is composed of conductive shaft (made of metal or the like) and a conductive resilient body provided around the conductive shaft. The conductive resilient body is composed of, for example, epichlorohydrin rubber in which carbon black (as conductive material) is dispersed. The cleaning rollers 408K, 408Y and 408M are mounted to the blue, yellow and magenta image forming units 20K, 20Y and 20M.

The cleaning roller 409 is composed of conductive shaft (made of metal or the like) and a conductive resilient body provided around the conductive shaft. The conductive resilient body is composed of, for example, epichlorohydrin rubber in which carbon black (as conductive material) is dispersed. The cleaning roller 409 is applied with a superimposed voltage (as a bias voltage) in which alternate voltage and direct voltage are superimposed. The cleaning roller 409 is mounted to cyan image forming unit 20C.

The voltage applying unit 410 superimposes direct voltage of, for example, +800V and alternate voltage of, for example, 2.0 kV (peak-to-peak voltage) at 600 Hz, and applies the superimposed voltage to the cleaning roller 409. The voltage control unit 411 controls the superimposed voltage that the voltage applying unit 410 applies to the cleaning roller 409 and a timing when the voltage applying unit 410 applies the superimposed voltage to the cleaning roller 409.

The voltage applying unit 420 applies the voltages of, for example, +1000V whose polarity is opposite to the toner 150 to the cleaning rollers 408K, 408Y and 408M. The voltage control unit 421 controls the voltages that the voltage applying unit 420 applies to the cleaning rollers 408K, 408Y and 408M and a timing when the voltage applying unit 420 applies the voltages to the cleaning rollers 408K, 408Y and 408M.

Next, the cleaning operation by the cleaning rollers 409, 408K, 408Y and 408M of the printer 500 will be described.

The cleaning roller 409 is applied with the superimposed voltage in which the direct current of +800V and the alternate current of 0.2 kV (peal-to-peak voltage) at 600 Hz. With such a voltage, the cleaning roller 409 attracts the toner 150 from the circumferential surface of the photosensitive drum 101C.

Further, the cleaning rollers 408K, 408Y and 408M are applied with the voltages of +1000V whose polarity is opposite to the toner 150. With such voltages, the cleaning rollers 408K, 408Y and 408M respectively attract the toner 150 from the circumferential surfaces of the photosensitive drums 101 of the image forming units 20K, 20Y and 20M.

In this regard, in the image forming unit 20C, the recovery operation of the toner 150 adhering to the cleaning roller 409 is performed between printing jobs or at predetermined intervals (for example, every 20 pages of printing). In the recovery operation, the toner 150 on the cleaning roller 409 is first transferred to the photosensitive drum 101, then transferred to the transfer belt 21, and then recovered by the transfer belt cleaning member 26.

To be more specific, in the recovery operation, the cleaning roller 409 is applied with a voltage of −1400V by the voltage applying unit 310, with the result that the toner 150 moves to the surface of the photosensitive drum 101C whose electric potential is almost 0V.

As the photosensitive drum 101C rotates, the toner adhering to the photosensitive drum 101C moves to a portion facing the charging roller 102. In this state, the charging roller 102 is applied with a voltage of −1000V by the voltage supply portion (not shown), and therefore the toner 150 held on the photosensitive drum 101C passes the charging roller 102.

The LED head 103 exposes the photosensitive drum 101C to cause the electric potential of the photosensitive drum 101C to be 0V. As the photosensitive drum 101C further rotates, the toner moves to a portion facing the developing roller 104. In this state, the developing roller 104 is applied with the −300V by the voltage supplying portion (not shown), and therefore the toner 150 held on the photosensitive drum 101C passes the developing roller 104.

The transfer roller 22 is applied with +1000V by the supplying portion (not shown), and the toner on the photosensitive drum 101C is transferred to the transfer belt 21. As the transfer belt 21 moves, the toner 150 adhering to the transfer belt 21 is scraped off therefrom by the transfer belt cleaning member 26, and stored in the developer recovery container 27.

The recovery operation of the toner from the cleaning rollers 408K, 408Y and 408M is performed in a similar manner to the recovery operation of the toner from the cleaning roller 409. In this regard, the recovery operation of the toner from the cleaning rollers 408K, 408Y and 408M can be performed at the same time as the recovery operation of the toner from the cleaning rollers 409. Alternatively, respective recovery operations of the toner from the cleaning rollers 409, 408K, 408Y and 408M can be individually performed. In this case, it is possible to employ a configuration of the printer 10 in which the image forming unit including the cleaning roller from which the toner is to be recovered is brought into contact with the transfer belt 21, and the other image forming units are shifted apart from the transfer belt 21.

In the fourth embodiment of the present invention, the cleaning device uses the cleaning roller 409 applied with the superimposed voltage in which direct voltage and alternate voltage are superimposed. Therefore, the printing speed can be increased, and steady cleaning performance can be obtained.

In particular, using the above described superimposed voltage, electric field between the cleaning roller 409 and the photosensitive drum 101 can be uniformized (and therefore the steady cleaning performance can be obtained), even when there is a change in contact area between the cleaning roller 409 and the photosensitive drum 101 due to deformation of the surface of the cleaning roller 409 resulting from the effect of the heat of the fixing portion 25.

In the above described embodiments, the cyan image forming unit closest to the fixing portion has different cleaning device from the cleaning devices of the black, yellow and magenta image forming units. However, the present invention is not limited to such configuration. For example, it is also possible that the cyan and magenta image forming units have cleaning devices which are different from the cleaning devices of the black and yellow image forming units. Further, it is also possible that the cyan, magenta and yellow image forming units have cleaning devices which are different from the cleaning device of the black image forming unit.

The present invention is also applicable to, for example, an image forming apparatus employing two-component development method using toner and carrier. The present invention is applicable to, for example, a printer, a facsimile machine, a copier and a multifunction peripheral having a plurality of functions, or the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a plurality of image forming units for forming a developer image on a recording medium, and a fixing device for fixing the developer image to the recording medium, each of said image forming units comprising an image bearing body that bears the developer image, and a cleaning portion that removes residual developer from said image bearing body, and said cleaning portion of said image forming unit disposed closest to said fixing device and including a cleaning blade that has repulsion elasticity at a predetermined temperature, and said repulsion elasticity being lower than that of a cleaning blade of said cleaning portion of at least one of said image forming units disposed farther from said fixing device.

2. The image forming apparatus according to claim 1, wherein said image forming units are disposed along a feeding path of the recording medium.

3. The image forming apparatus according to claim 1, wherein said fixing device is disposed on a downstream side of said image forming units along said feeding path of the recording medium.

4. The image forming apparatus according to claim 1, wherein said image forming unit disposed closest to said fixing device is disposed at a most downstream position among said image forming units.

5. The image forming apparatus according to claim 1, wherein said predetermined temperature is in a range of a temperature of said cleaning blade during an image forming operation.

6. The image forming apparatus according to claim 1, wherein said image forming unit disposed closest to said fixing device is configured to form a developer image of a color other than black.

7. The image forming apparatus according to claim 1, wherein said repulsion elasticity of said cleaning portion of said image forming unit closest to said fixing device is lower than said repulsion elasticity of said cleaning portion of said image forming unit second closest to said fixing device, and wherein said repulsion elasticity of said cleaning portion of said image forming unit second closest to said fixing device is lower than said repulsion elasticity of said cleaning portion of said image forming unit third closest to said fixing device.

8. An image forming apparatus comprising:

a plurality of image forming units for forming a developer image on a recording medium, and a fixing device for fixing the developer image to the recording medium, each of said image forming units comprising an image bearing body that bears the developer image, and a cleaning portion that removes residual developer from said image bearing body, and said cleaning portion of said image forming unit disposed closest to said fixing device including a cleaning blade pressed against said image bearing body with a contact pressure, and said contact pressure being different from a contact pressure between a cleaning blade and said image bearing body in at least one of said image forming units disposed farther from said fixing device at least when said image forming units form developer images of a plurality of colors;

wherein said contact pressure of said cleaning portion of said image forming unit closest to said fixing device is higher than said contact pressure of said cleaning portion of said image forming unit second closest to said fixing device, and wherein said contact pressure of said cleaning portion of said image forming unit second closest to said fixing device is higher than said contact pressure of said cleaning portion of said image forming unit third closest to said fixing device.

* * * * *